United States Patent [19]

Egense et al.

[11] Patent Number: 4,873,930

[45] Date of Patent: Oct. 17, 1989

[54] SULFUR REMOVAL BY SORBENT INJECTION IN SECONDARY COMBUSTION ZONES

[75] Inventors: Andrea L. F. Egense, Cerritos; John D. Kuenzly, Redondo Beach, both of Calif.

[73] Assignee: TRW Inc., Redondo Beach, Calif.

[21] Appl. No.: 319,803

[22] Filed: Mar. 7, 1989

Related U.S. Application Data

[63] Continuation of Ser. No. 252,035, Sep. 29, 1988, abandoned, which is a continuation of Ser. No. 79,373, Jul. 30, 1987, abandoned.

[51] Int. Cl.[4] ..... F23J 11/00

[52] U.S. Cl. ..... 110/345; 110/229; 110/264; 110/343; 110/347

[58] Field of Search ..... 110/345, 229, 264, 343, 110/347

[56] References Cited

U.S. PATENT DOCUMENTS

| | | | |
|---|---|---|---|
| 2,516,141 | 7/1950 | Newman et al. . | |
| 2,971,480 | 2/1961 | Sage | 110/265 |
| 3,124,086 | 3/1964 | Sage et al. . | |
| 3,250,236 | 5/1966 | Zelinski . | |
| 3,357,383 | 12/1967 | Golovanov et al. . | |
| 3,358,624 | 12/1967 | Way . | |
| 3,540,387 | 11/1978 | McLaren et al. . | |
| 3,693,557 | 9/1972 | Makuch . | |
| 3,717,700 | 2/1973 | Robinson et al. . | |
| 3,966,431 | 6/1976 | Craig et al. . | |
| 4,022,591 | 5/1977 | Staudinger . | |
| 4,111,755 | 9/1978 | Ban et al. | 110/342 X |
| 4,147,116 | 4/1979 | Graybill | 110/263 |
| 4,217,132 | 8/1980 | Bunge et al. | 75/26 |
| 4,235,585 | 11/1980 | Anderson | 431/4 X |
| 4,285,283 | 8/1981 | Lyon et al. | 110/229 X |

(List continued on next page.)

FOREIGN PATENT DOCUMENTS 551776 3/1982 Australia .

OTHER PUBLICATIONS

Conoco Technical Bulletin, TB 1/84 BJK May 1950.

Freund et al., Combustion and Flame 45: 191–203 Jun. (1982).

Freund, Combustion Science and Technology, Jul. 1981, vol. 26, pp. 83–88.

Jensen et al., ACS Symposium Series, No. 196 Chemical Reaction Engineering–Boston, pp. 335–346, Wei et al., Editors Jun. (1982).

VGB Kraftwerkstechnik 66 (VGB Power Plant Engineering), vol. 7, Jul. 1986, pp. 637–645.

Frey, TRW Coal Combuster $NO_x$ Emissions, TRW, Inc. Mar. 25, 1987, 27 pages.

*Primary Examiner*—Henry C. Yuen

*Attorney, Agent, or Firm*—Jeffrey G. Sheldon; Benjamin DeWitt

[57] ABSTRACT

The generation of acid rain precursors, i.e., $SO_x$ and $NO_x$, and slag during the combustion of a carbonaceous fuel, e.g., coal, is counteracted in a slagging combustor apparatus and process. The fuel is combusted in a primary combustor under substoichiometric combustion conditions and at a temperature greater than the fuel's ash fusion temperature. The substoichiometric combustion conditions suppress the formation of $NO_x$. Most of the noncombustibles are separated from the gaseous products of combustion, in the form of liquid slag, to form treated gaseous combustion products having a noncombustible content that is substantially reduced with respect to the noncombustible content of the fuel. The temperature of the treated gaseous combustion as it leaves the primary combustion is above the ash fusion tmeprature of the fuel. A sorbent is introduced into the treated gaseous combustion products and calcined. The calcined sorbent removes $SO_x$ from the treated gaseous combustion products. The temperature of the treated gaseous combustion products is preferably reduced after the introduction of the sorbent to avoid deadburning the surbent. It is als preferred to add additional oxidant to the treated gaseous combustion products to raise the overall stoichiometry of the process to at least one to avoid emitting smoke into the atmosphere.

56 Claims, 5 Drawing Sheets

U.S. PATENT DOCUMENTS

| | | | |
|---|---|---|---|
| 4,331,638 | 5/1982 | Michelfelder | 431/4 X |
| 4,346,064 | 8/1982 | Leon | 110/345 X |
| 4,377,118 | 3/1983 | Sadowski | 110/343 |
| 4,381,718 | 5/1983 | Carver et al. | 110/347 |
| 4,395,975 | 8/1983 | Ashworth et al. | 110/229 X |
| 4,423,702 | 1/1984 | Ashworth et al. | 110/229 X |
| 4,424,765 | 1/1984 | Strohmeyer, Jr. | 110/245 X |
| 4,458,606 | 7/1984 | Merrell | 110/343 |
| 4,469,032 | 9/1984 | Yan | 110/342 |
| 4,481,892 | 11/1984 | Mah | 110/263 |
| 4,498,402 | 2/1985 | Kober et al. | 110/345 |
| 4,500,281 | 2/1985 | Beardmore | 431/10 X |
| 4,507,075 | 3/1985 | Buss et al. | 110/265 X |
| 4,514,256 | 4/1985 | Kober et al. | 110/343 X |
| 4,517,904 | 5/1985 | Penterson et al. | 110/264 |
| 4,542,704 | 9/1985 | Brown et al. | 110/229 X |
| 4,555,392 | 11/1985 | Steinberg | 110/345 X |
| 4,561,364 | 12/1985 | Green et al. | 110/347 |
| 4,566,392 | 1/1986 | Ishihara | 110/342 |
| 4,582,005 | 4/1986 | Brown | 110/347 |
| 4,586,443 | 5/1986 | Burge et al. | 110/347 |
| 4,613,487 | 9/1986 | Yoon et al. | 110/345 X |
| 4,651,653 | 3/1987 | Anderson et al. | 110/234 |
| 4,655,148 | 4/1987 | Winship | 110/264 X |
| 4,660,478 | 4/1987 | Sheppard et al. | 110/264 |
| 4,685,404 | 8/1987 | Sheppard et al. | 110/263 X |
| 4,800,825 | 1/1989 | Kuenzly | 110/345 |

SULFUR REMOVAL BY SORBENT INJECTION IN SECONDARY COMBUSTION ZONES

CROSS-REFERENCE

This application is a continuation of U.S. patent application Ser. No. 252,035 filed Sept. 29, 1988, now abandoned, which is in turn a continuation of U.S. patent application Ser. No. 079,373 filed July 30, 1987, now abandoned.

BACKGROUND OF THE INVENTION

Conventional coal-burning boiler plants and industrial furnaces combust coal in a reaction zone directly within the furnace. They are normally operated at an overall stoichiometry greater than one. This eliminates smoking but results in generation of substantial quantities of the oxides of nitrogen and the oxides of sulfur, as well as relatively high production of particulates, which require the use of high efficiency particulate collection devices such as baghouses. Such furnaces have relatively low energy release per unit volume, therefore requiring large volume "fire boxes" for burning of the fuel and extracting energy from the flame.

In recent years, oil prices have increased by about a factor of seven. Many electric-utility boiler plants and industrial furnaces were caught in a cost squeeze. Conversion of these boilers and furnaces with retrofit systems to burn coal rather than oil or gas, could provide very substantial energy-cost savings. But, attempting to burn coal in multi-megawatt boilers originally designed and constructed for oil or gas presents several difficulties that have been thought to be insurmountable: Slag and fly-ash from coal burning in such boilers would coat furnace and convective tubes, sharply reducing efficiency; uncontrolled emission of sulfur oxides (herein $SO_x$) and/or nitrogen oxides (herein $NO_x$) is prohibited by federal and local agencies in the urban and semi-urban locales where electricity-generating boiler plants are commonly located; in addition, most often the space available for installation of coal handling and combustion equipment is severely limited; and, boilers originally designed for oil and gas usually have no provision for ash collection and disposal.

We have developed a process and apparatus, suitable for retrofit installation on pre-existing boilers and furnaces, that removes most of the non-combustible mineral constituents of the fuel (e.g., coal) while combusting the fuel at heretofore unrealizable power densities and avoiding excessive generation of acid rain precursors, such as $SO_x$ and $NO_x$. The desiderata, and performance characteristics of our invention, are:

High power density: about 1.0 million Btu/hour per cubic foot of volume of the primary combustion chamber.

Low $NO_x$: Consistently less than 450 ppmv and, preferably, less than 250 ppmv in the gases emitted into the atmosphere.

Removable of Noncombustibles: Capture, and removal from the gaseous products of combustion, of 80% to 90% of the noncombustible-minerals content of the fuel before the gaseous products are conducted to the boiler or other heat-utilization equipment, depending on the requirements of the specific end-use equipment.

Carbon Carryover: Conversion of substantially all carbon to oxides of carbon before the gaseous products pass to the boiler or other heat utilization equipment.

Durability: Protection of the walls of the combustor so that deleterious corrosion and/or erosion of the walls is kept within commercially acceptable limits.

Thermal Efficiency: Delivery to the end-use equipment of a gaseous-products stream having about 85 to 90 percent of the chemical potential energy of the carbonaceous fuel. Preferably this energy is delivered partly as sensible heat and partly in the form of carbon monoxide and hydrogen contained in the gaseous products and readily combustible, to completion, in the end-use equipment.

Sulfur Capture: Removal of 80–90% of the sulfur-bearing constituents of the fuel from the gaseous products before the gaseous effluents pass from the heat-utilization facility into the atmosphere.

U.S. Pat. No. 4,217,132 to Burge et al., incorporated herein by reference, describes an apparatus for combusting carbonaceous fuel that contains noncombustible mineral constituents, separating such constituents as liquid slag and conveying a stream of hot combustion products to a thermal energy utilization equipment, such as a boiler. In the Burge et al. apparatus solid carbonaceous fuel (e.g., powdered coal) is injected into a combustion chamber and, simultaneously, a stream of oxidizer (e.g., preheated air) is introduced into the chamber to produce high velocity swirling flow conditions therein suitable for centrifugally driving most of the liquid slag to the inside walls of the chamber. Another system meeting, in part, the foregoing objectives is described in copending patent application Ser. No. 788,929 filed October 18, 1985 incorporated herein by reference (subsequently abandoned).

The apparatus described in patent application Ser. No. 788,929 relates to improvements in slagging combustors, resulting from extensive study and development including recognition of requirements peculiar to adapting slagging combustors to industrial furnaces and electric-utility boilers originally designed and constructed to use oil and/or natural gas.

Our invention is directed to further improvements in slagging combustion systems belonging to the same general class as that disclosed by Burge et al. and copending patent application Ser. No. 788,929 and, more particularly, to reduction of $SO_x$ and $NO_x$ emissions while simultaneously meeting the other desiderata described above.

SUMMARY OF THE INVENTION

In accordance with the present invention, a stream of hot, fuel-rich gaseous products (preferably flowing from a system such as that described in copending patent application Ser. No. 788,929) is fed as a thermal-energy carrying fuel gas input to a conventional boiler or furnace. These gaseous products have a temperature equal to or higher than the ash-fusion temperature of the fuel's noncombustible constituents, preferably within the range from about 2600° F. to about 3200° F. Substantially as this stream of gaseous products enters the furnace, we mix with it (1) an alkaline earth metal-containing sorbent for sulfur, such as pulverized limestone, and (2) enough supplementary oxidizer to increase the overall stoichiometry of the facility to about 1.1 to about 1.3. Because the sulfur sorbent is intimately contacted with the high-temperature gaseous products and rapidly intermixed therewith, the sulfur sorbent is flash-calcined within times of the order of a few milliseconds to form high-porosity solid particles suitable for promoting reaction of the sorbent's alkaline earth metal with sulfur constituents contained in the gaseous products. Consequently, most of the sulfur content of the fuel is converted to alkaline earth metal sulfates and may be removed from the gaseous products before the same pass from the boiler or furnace facility into the atmosphere. By using this process and apparatus we have repeatedly and consistently reduced, by 80% to 90%, the concentration of $SO_x$ in the flue gasses. To our knowledge, no other coal combustion process or apparatus suitable for conventional electric-utility boilers and industrial furnaces has realized comparable reduction of sulfur oxide emissions.

In a preferred embodiment comminuted carbonaceous fuel, such as pulverized coal, is introduced into a combustion zone near the center of one end thereof. A stream of oxidizer is injected into the combustion zone in a manner and direction to establish a high-velocity swirling flow of a mixture of oxidizer and combustion products adjacent the walls of the combustion chamber. High power density combustion converts the fuel to gaseous combustion products, comprising carbon monoxide and hydrogen, together with molten slag resulting from fusion of the noncombustible mineral constituents of the fuel. The high-velocity swirling flow creates a regime in which most of the molten slag is centrifugally propelled to the inside surfaces of the walls of the combustion zone.

The input velocities and mass-flow rates of both the oxidizer and the pulverized fuel are regulated as independent variables for controlling conditions within the combustion zone. More specifically, by controlling these independent variables we regulate the system to:

(a) keep combustion temperatures in the combustion zone higher than the ash-fusion temperature of the noncombustible mineral constituents of the fuel, such temperature normally being within the range from about 2600° F. to about 3200° F. depending on the characteristics of the specific fuel, (b) minimize carry over of volatilized and/or liquid slag droplets in the gaseous products of combustion, (c) maintain the overall stoichiometry of the combustion zone in the range from about 0.7 to about 0.9, (d) convert substantially all of the carbon contained in the fuel to oxides of carbon (e.g., CO and $CO_2$), and (e) separate most of the ash from the gaseous products of combustion, in the form of molten slag.

The gaseous products of combustion, containing sulfur compounds, are passed to a slag collection zone and passed therefrom by a suitable duct to an associated heat-utilization equipment such as a conventional furnace or boiler. Immediately before or substantially as the combustion products pass into the heat-utilization equipment supplementary oxidizer and sulfur-sorbent material are combined with the combustion products to achieve a stoichiometry preferably in the range of about 1.1 to about 1.3, more preferably about 1.2. Rapid mixing results in an attendant temperature decrease to at least about 2300° F. where sulfur capture is maximized. The amount of sorbent introduced preferably is sufficient to provide a molar ratio of alkaline earth metal to sulfur of about 2 to about 5, depending on the sulfur content of the coal and the degree of $SO_x$ reduction required; this molar ratio is more preferably about 2.5 to about 3.5. $SO_x$ reductions in the range of 60–90% are achieved, depending on the type of coal used. Heat is extracted from the products of secondary oxidation and spent sorbent with small amounts of fly-ash is collected by suitable means such as a baghouse.

Preferably, we do not add this supplementary oxidizer to the gaseous products until after such products leave the slag-recovery zone; rather, the stoichiometry in the slag-recovery chamber is kept fuel rich, within the range from about 0.7 to about 0.9, thereby minimizing the formation of nitrogen oxides; also the temperature therein is kept above the ash-fusion temperature, facilitating the removal of residual noncombustibles in the form of molten slag. Accordingly, the gaseous products, with substantially all slag removed, are passed from the slag recovery chamber to and into the associated heat utilization equipment in the form of a high-velocity swirling stream of fuel gas carrying both kinetic energy in the form of sensible heat and potential energy in the form of substantial concentrations of CO and $H_2$. The temperature of this stream as it leaves the slag recovery chamber is above the ash-fusion temperature of the noncombustible constituents of the fuel with the specific temperature, in the range from about 2600° F. to about 3200° F., being dependent on the characteristics of the fuel used.

Substantially as the gaseous products pass into the heat utilization equipment we add supplementary oxidizer, for two purposes: Firstly, it is desirable to provide enough supplementary oxidizer (e.g., air) to complete combustion of the fuel gas and provide an overall stoichiometry in the furnace or boiler of about 1.1 to about 1.3. Secondly, either before or soon after the sulfur sorbent is mixed with the gaseous products, it is desirable to reduce the temperature of the gaseous products to a level low enough to avoid dead burning of the sorbent particles. The temperature of the gaseous products preferably is reduced to at least about 2300° F., shortly after they pass into the heat utilization equipment. It is to be appreciated, of course, that adding supplementary oxidizer results in combustion of CO and $H_2$ contained in the gaseous products, with the concomitant release of thermal energy tending to increase the temperature of the flame. This tendency is offset by radiative transfer of thermal energy from the gaseous products to the much colder water-tube walls of the boiler and mixing with cooler gases recirculating in the boiler or furnace. An important aspect of our invention is rapidly mixing the sulfur sorbent (e.g., pulverized limestone) with the substantially slag-free gaseous products under optimum conditions for rapid calcination of the sorbent, converting it to a physical form that enhances its reactivity for capture of sulfur compounds contained in the gaseous products. The relatively slag-free gaseous products, flowing from the slag-recovery chamber, function as an intense, torch-like source of radiant energy. The introduced sorbent, e.g., calcium carbonate, even if not intimately mixed into the gaseous products, is almost instantaneously calcined, decomposing to form CaO and $CO_2$ within transit times of the order of a few milliseconds. This rapid calcination results in high-porosity particles of calcium oxide having a relatively very high surface area-to-mass ratio, which enhances contacting the CaO with $SO_2$ and other sulfur species and, hence, remarkably improves removal of sulfur from the gaseous products before such products pass from the heat-utilization equipment into the atmosphere.

DETAILED DESCRIPTION

Figure 1:
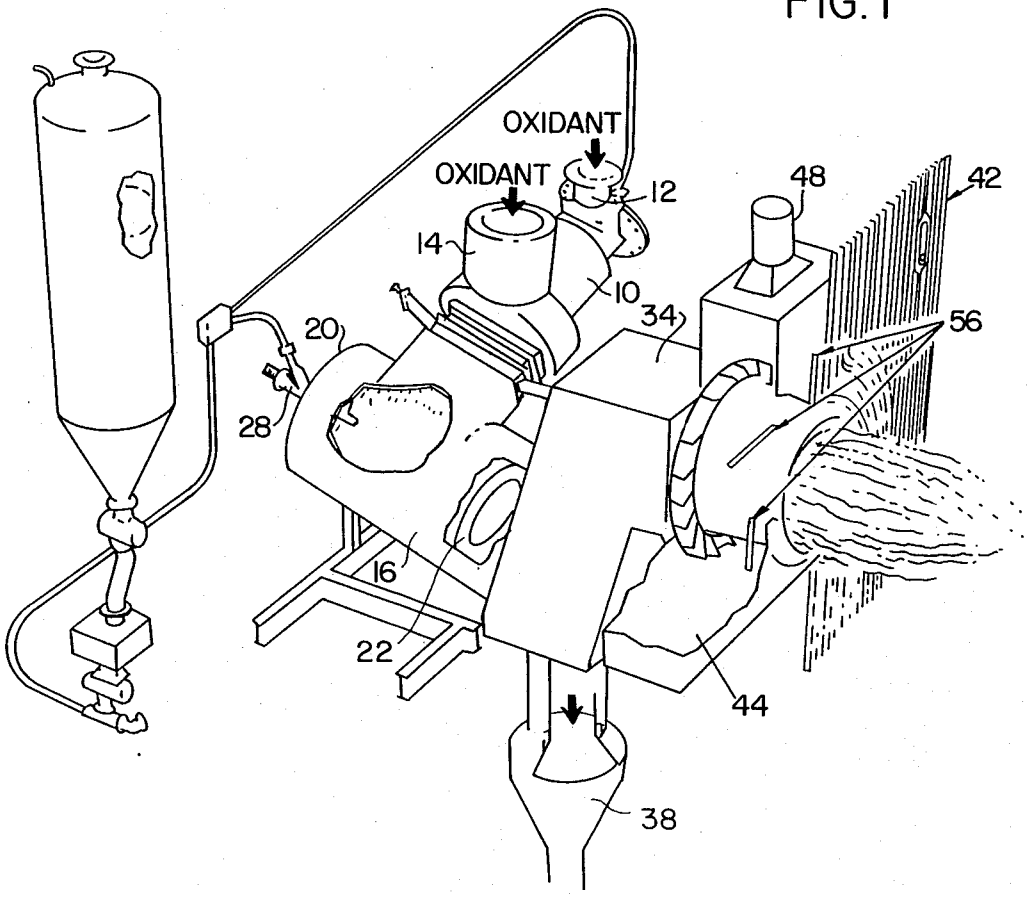
FIG. 1 is a view in prospective of a slagging combustor-furnace combination including a secondary air and sulfur sorbent injection system.

There is provided, in accordance with the present invention, a system employing particular apparatus and methods for more efficiently recovering sulfur during the generation of energy from the combustion of carbonaceous fuel while removing solid noncombustibles to the highest levels possible, at the same time minimizing the generation of nitrogen oxides, and collecting and removing 80 to 90% or more of the molten slag before the gaseous products are introduced into an associated thermal energy utilization equipment wherein, a sorbent for sulfur is reacted with sulfur-bearing constituents of the gaseous products.

The achievement of these improvements is brought about by the use of methods and apparatus which prepare the particulate carbonaceous materials and the oxidant used to combust them for rapid ignition and reaction in fluid dynamic flow fields.

The presently preferred apparatus comprises, in combination, the following mechanical units: a precombustor, a primary combustion chamber, a slag-collection unit and a conduit coupled to a furnace, means to introduce supplementary oxidant to the secondary oxidation burner and means to add sulfur sorbent to the gaseous products flowing from the slag-collection unit, substantially as or shortly before such gaseous products are passed into the furnace.

By the term "particulate carbonaceous fuel" as used herein, there is meant carbon-containing substances that include noncombustible minerals and which can be provided as a fuel in a dispersed state, either suspended in a carrier fluid as free particles, or as a slurry. Representative carbonaceous materials include, among others, coal, char, the organic residue of solidwaste recovery operations, tarry oils that are dispersible in liquid, and the like. In principle the carbonaceous fuel may be any material that is amenable to dispersion within the primary combustion chamber as discrete droplets or particles and may be combusted therein to form a high velocity stream of gaseous products, including $H_2$ and CO. Typically, the fuel is pulverized coal.

By the term "oxidant" there is meant air or oxygen-enriched air.

By the term "carrier fluid" we mean a gas or liquid, which may be inert or an oxidant. An oxidant is a preferred carrier gas, and water is a preferred carrier liquid.

By the term "slagging combustor" we mean an apparatus of the general class represented by Burge et al and/or patent application Ser. No. 788,929, in which carbonaceous fuel (e.g., pulverized coal) is combusted under conditions such that most of the ash is separately removed from the gaseous products in the form of molten slag.

By the term "alkaline earth metal" there is meant elements of Group II(a) of the Periodic Table, significantly calcium and magnesium.

By the term "sulfur sorbent" we mean a material suitable for reaction with sulfur compounds contained in the gaseous products to enable removal of most of the sulfur-bearing constituents in the form of solids capable of being collected in a conventional baghouse or other subsystem for removing particulate solids from the flue gases before the same pass into the atmosphere. One may use substantially any alkaline earth metal based material that will react with sulfur compounds contained in the gaseous products of combustion. Calcium compounds such as comminuted limestone, dolomite, and magnesium compounds, such as magnesium carbonate or the like, may be used. A presently preferred sulfur sorbent is pulverized limestone of a particle size such that about 70% of the particles will pass through 20 mesh screen.

With reference now to FIGS. 1, 2, 2A and 3 which illustrate the preferred operating system of our invention, preconditioning of oxidant is accomplished in a short and compact cylindrical precombustor 10 to which essentially all of the first oxidant is supplied. A portion of the first oxidant is introduced at conduit 12 and used, in part, to combust from about 10% to about 25% of the total carbonaceous feed to form a first reaction product. A second portion of the first oxidant enters the precombustor 10 at conduit 14 and mixes with the first reaction product to form a hot, oxidant-rich gas stream which is directed in a controlled fashion into primary combustion chamber 16. The oxidant-rich gas stream carries with it all residual precombustor fuel and non-combustibles, including still-burning carbonaceous particles dispersed throughout its volume. Precombustor exit temperature may range from about 1500° F. to about 2000° F. or more.

In operation, the particulate carbonaceous material in the precombustor is introduced, in most instances as solids, into an intense, whirling gas field at the head end of the precombustor 10. Introduction is through a centrally-located injector (not shown) that produces a conical flow of particulate carbonaceous materials mixed into a whirling flow field of first oxidant. The whirling flow field of first or primary oxidant and resulting reaction products produces a strong recirculation zone of hot gases and combusting particles, once ignition is achieved. Precombustor geometry enables self-sustaining combustion when air is used as the oxidant and such air is introduced at temperatures of from about 300° F. or higher. The precombustor is preferably arranged, with all flows being downward from the head end to rectangular exit 18, to assure that no solids or liquid slag remain in precombustor 10. The overall stoichiometry is regulated by controlling the mass-flow rate of particulate carbonaceous material into the first oxidant flow to maintain the above precombustor exit temperatures.

The heated first oxidant and reactants, generated in precombustor 10, move through a rectangular shaped exit 18 into primary combustor 16 also of cylindrical geometry. This precombustor-effluent stream is introduced substantially tangential to the interior wall of primary combustor chamber 16. The rectangular exit 18 of precombustor 10 is sized such that the dimension parallel to the axis of the primary combustor is larger than the dimension perpendicular to the axis of the primary combustor. A length-to-height ratio of 2.5 to 1 is preferred. Preferably, the centerline of the rectangular exit is aligned with the longitudinal axis of the precombustor and is positioned, upstream from the midpoint of the primary combustor's longitudinal axis, i.e., about ⅓ to ½ of the distance from the head end 20 to the primary combustor's apertured baffle 22.

Figure 2:
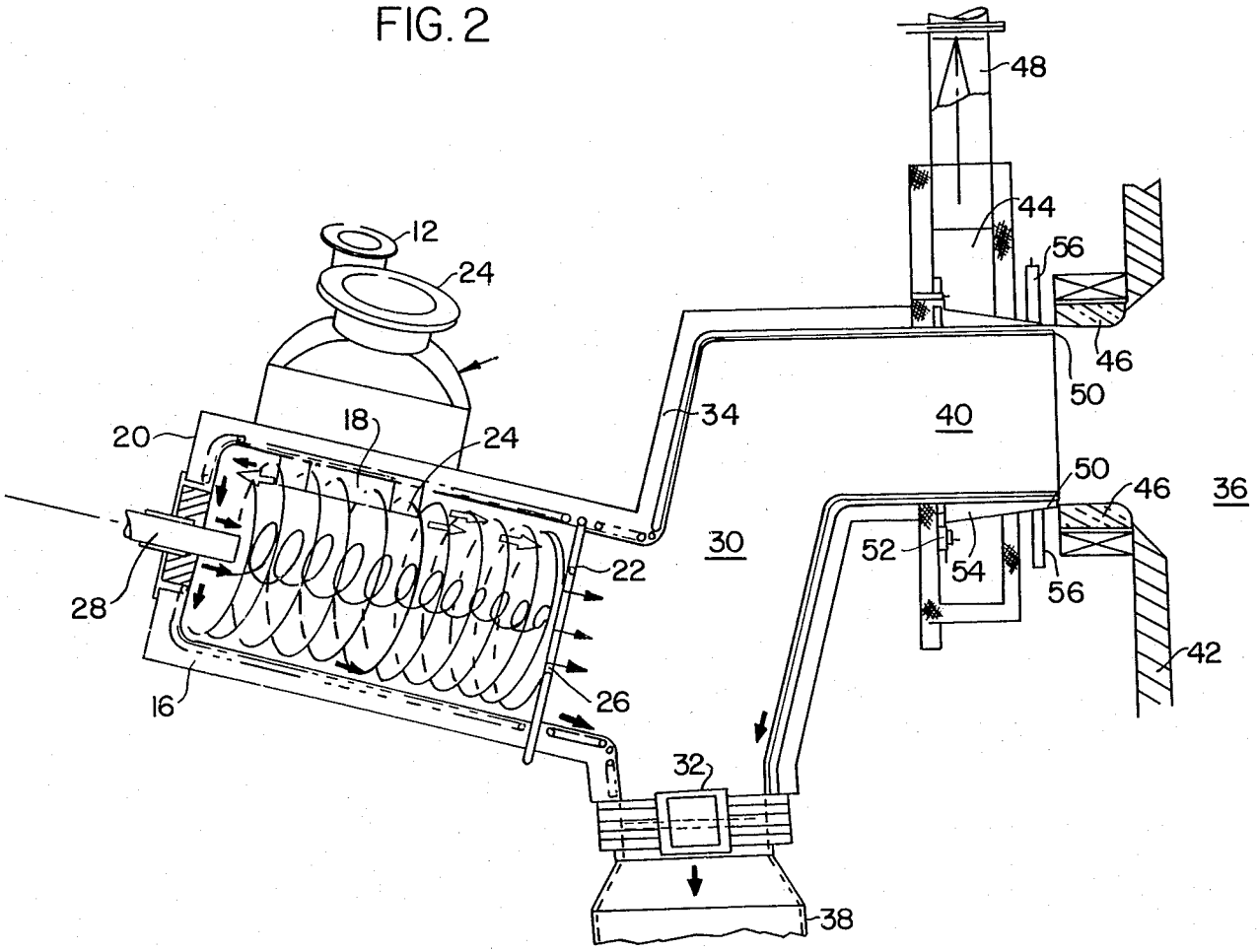
FIG. 2 is a more detailed side view of the apparatus of FIG. 1 depicting in part dynamics of operation.

By locating the rectangular exit 18 of precombustor 10 in the above-described manner, the precombustor effluent causes a swirling motion to be imparted to the flow within primary combustor 16. We have found that, by controlling the precombustor exit velocities to the order of 330 fps, through the use of damper plates 24 located within the rectangular exit region of precombustor 10, satisfactory combustion is achieved over a wide range of primary combustor fuel feed rates. As depicted in FIG. 2, the above-described location of rectangular exit 18 also causes a division of the effluent into two nearly-equal flows: one flow whirls along the walls toward the head end, while the other flow generally moves helically along the wall of primary combustor 16 toward its exit. The axial component of the whirling flow toward the head end has a relatively low velocity, generally in the order of 50 fps. This flow is turned inward at the head-end 20 of the primary combustor, and then axially back towards the exit of the primary combustor, all the while following helical flow paths. The exit end of the primary combustor is provided with a baffle plate 22 perpendicular to the axis of the primary combustor and which has a generally centrally-located aperture.

The major part of the carbonaceous fuel is introduced into the primary combustor, approximately at the center of the head end through a fuel-injector assembly 28, which extends into the primary combustor 16 from the head end 20 to a point slightly upstream of the rectangular opening 18. Assembly 28 causes the particulate carbonaceous material to be introduced as solids in a gas or liquid carrier, in a conical flow pattern, into the swirling flow field.

As noted above, the heated first oxidizer inflow to the primary combustor 16 divides into two streams, with about 50% of the precombustor effluent flowing toward the head end 20, where fuel ignition occurs in a fuel-rich reaction zone, with an overall head-end stoichiometry of from about 0.4 to about 0.5. The balance of the incoming oxidizer flows towards exit end 22 of the primary combustor 16. The interaction of the conical-pattern fuel injection with the high-velocity swirling flow field provides intimate and rapid mixing of the fuel, heated oxidizer and products of combustion. The bulk of the fuel's combustibles are oxidized in flight through the heated oxidizer flow field, giving up energy in the form of heat of reaction and further heating the resultant combustion products. The particles in free flight follow generally helical flow paths towards the walls and exit end of the primary chamber, all as more extensively described in copending patent application Ser. No. 788,929.

In typical operation, a small fraction, preferably not more than about 12%, of the carbon content of the fuel reaches the wall of the primary combustor in the form of unburned carbon, normally a combustible char, which continues to be consumed. A layer of molten slag, having a viscosity of the order of 250 poise, flows helically along the walls of the primary chamber, in response to aerodynamic drag and gravity, toward the exit-end baffle 22. Typically, combustion of the fuel takes place through a rapid heating of the particles, which causes a gasification of volatile organics, which may be in the order of from 30% to 50% by weight of the total combustibles. The remainder is combusted essentially to particles of char, primarily while in flight within chamber 16.

Fuel-rich gases generated in the head end of the primary combustor 16, generally flow towards the exit-end baffle 22 while the swirling flow is maintained, and are finally forced inward by the baffle plate, react with the fuel and fuel-rich gases, bringing the overall stoichiometry of primary combustor 16 up to a level of from about 0.7 to about 0.9, preferably from about 0.7 to about 0.8, and yielding, as the output product of the primary combustor, a stream of hot products of combustion, rich in CO and $H_2$ and from which most of the noncombustibles have been removed as liquid slag.

The internal mixing and reaction are further enhanced in the primary combustor by a strong secondary recirculation flow along the centerline of primary combustor 16, the flow moving generally along the centerline towards the head end of the primary combustor. This recirculation flow is, also, swirling and, therefore, substantially helical; but its axial component is toward the head end of the primary combustor. It produces a fuel-rich core portion within the primary combustor 16. The average diameter and mass-flow rate of this reverse-flowing core portion is determined and controlled by the precombustor exit-flow velocity and selection of the diameter of the primary combustor's baffle aperture 26. Preferably, precombustor exit velocity is about 330 fps. A preferred ratio of baffle opening diameter to primary combustor diameter is approximately 0.5 or more. This produces ideal secondary recirculation flows for enhanced control of ignition and overall combustion in primary combustor 16.

From approximately the radius of baffle aperture 26 inwardly, the tangential velocity decreases to a value of essentially zero at the centerline of the primary combustor. This swirling flow field accelerates the fuel particles radially in their early consumption histories, and at the same time enables burned-out particles, down to about 10 microns, to be trapped within the primary combustor as molten slag.

Fuel injection assembly 28 is designed to allow molten slag to flow along its exterior surface from head end 20, towards the point of injection of the particulate carbonaceous fuel. This very hot (molten slag) exterior surface on the injector assembly functions as a flame holder to assure immediate ignition of fuel particles as they leave the injector, thereby promoting and maximizing efficient combustion. In operation, the flowing slag along the injector strips off short of the point of solid particle injection, and provides small-point centers of intense radiation and ignition of the head end-generated fuel-rich gases.

When a gaseous carrier fluid is used, the particulate carbonaceous fuel is carried into the primary combustor in dense-phase transport, wherein the solids-to-carrier fluid ratio at normal power levels is in the range from about 3 to 1 to about 10 to 1 by weight. Regulation of this solids-to-carrier fluid ratio within the above-stated range provides another independent variable means for controlling combustion conditions within primary chamber 16. When the fuel is fed as a liquid slurry, fuel to carrier fluid weight ratios of about 2:1 or higher may be used. The products of combustion are, in the primary combustor 16, sufficiently hot to maintain a molten slag layer at a temperature above the ash-fusion temperature of the fuel, and preferably high enough to maintain a molten slag layer having a viscosity of about 250 poise. Accordingly, slag flows freely along the walls of the primary chamber 16. Coolant flow to the metal walls of the primary chamber is controlled; particulate fuel mass-flow rate is controlled; and mass flow rate and velocity of oxidizer from the precombustor are also independently controlled. Coordinated regulation of these independent variables keeps the primary combustion zone temperature in a range such that slag vaporization is avoided, a protective slag layer is maintained on the metal walls and liquid slag flows continuously, over that slag layer, toward the slag disposal subassembly. Fuel rich combustion in the head end region and the core portion facilitate $NO_x$ control down to environmentally acceptable levels.

Preferably, the walls of the precombustor 10 and primary combustor 16 are made of water-cooled, tube-and-membrane construction, with a generally circumferentially-directed winding of the tubing. The tube-and-membrane structure is further equipped with slag-retaining studs. The containment walls are initially lined with a sacrificial refractor, applied at a nominal thickness of about 0.5 inch and maintained by the studs. In operation, the refractory employed causes the molten slag to tightly adhere to the refractory in a thin frozen layer, with the remainder of the slag flowing over the frozen-slag layer. After long periods of operation this refractory material is eroded away, i.e., sacrificed. But any portion thereof which is so eroded is immediately replaced by congealing slag. This combination of refractory and frozen and molten slag layers provide thermal and chemical protection to the welded tube-and-membrane wall structure. Local slag flow provides for self-replenishment of any lost refractory. Design of the cooling circuits provides for a metal wall temperature of from about 325° F. to 600° F., which precludes condensation of acidic compounds, thereby minimizing corrosion.

The longitudinal axis of primary combustor 16 is positioned, preferably, at an angle with respect to horizontal, to insure that proper slag flow occurs, avoiding accumulation of excessive quantities at the bottom of the primary combustor. The slag generally is driven, by aerodynamic drag forces, in a helical pattern towards the exit-end baffle 22 along the wall of the primary combustor 16. As the slag flow builds up along the wall, a larger portion of the molten slag flows to the bottom of the primary combustor, since the gravity forces exceed the aerodynamic forces. The bottom-collected slag flows toward the baffle plate 22. Baffle plate 22 has a centrally-located rectangular slot or "key hole" (not shown) extending from aperture 26 to the bottom wall of primary combustion chamber 16. This rectangular slot enables slag flow through the baffle plate, adjacent to the bottom wall of primary combustor 16. When burning 200-mesh coal, about 80% to 95% of the non-combustible content of the coal is removed from the gaseous product stream, captured as liquid slag, and disposed of by way of a slag-tapping subsystem located at the bottom of slag-recovery chamber 30, downstream of the key-hole baffle 22.

By providing a primary combustor length-to-diameter ratio of, nominally, 2 to 1; a baffle diameter-to-primary chamber diameter ratio of 0.5 or more, and with essentially free-flight burning of 200-mesh coal, as described herein, substantially all of the carbon content of the fuel is converted to oxides of carbon, CO and $CO_2$, before passing out of the primary chamber; there is virtually no carryover of unburned carbon out of the primary combustor 16. The combustion products and liquid slag from the primary combustor 16 pass into slag-recovery chamber 30. The slag-recovery chamber 30 preferably has a diameter equal to or greater than that of the primary chamber and an axial length approximately equal to its diameter. At its bottom is a slag-tapping aperture 32. At its top is a circular aperture, with a transition geometry arranged for coupling to conductor duct 34 extending to end-use equipment 36. As depicted, conduit 34 preferably leaves the slag-recovery section at an angle to the axis of primary combustor 16, and extends for about one to two length-to-diameter ratios before turning and directing the combustion-products stream horizontally towards the end use equipment. The slag-recovery unit 30 additionally provides a sufficient distance between the primary chamber's baffle 22 and the exit 40 so that a major portion of any residual slag droplets in the gaseous-products stream leaving baffle 22 are captured on the walls of the slag-recovery section 30.

The slag-recovery section 30, in conjunction with the baffle plate 22, provides a source of the hot recirculation gases which flow helically back into the core portion of primary combustor 16. This fuel-rich core portion is normally about 70% to about 75% of the diameter of the aperture of the primary chamber's baffle plate. This results in increased tangential and axial velocity of the exiting combustion-products stream at the baffle's aperture. Slag droplets which are in this flow are further accelerated towards the wall of the slag-recovery chamber 30 for capture as molten slag. More importantly, there is maintained in section 30 a high-velocity swirling flow of fuel-rich gases which form the feed to end-use equipment 36 and serve as an integral part of sulfur recovery in accordance with the practice of this invention. Captured slag collects in slag tank 38. Products of combustion under reducing conditions leave chamber 30 and enter transition conduit 40 leading to end-use apparatus 36 depicted as the front wall 42 of a furnace or conventional utility boiler.

Surrounding duct 40 is a wind box 44, fed by supplementary oxidant duct 48. Combustion gases exiting duct 40 combine with secondary oxidant from annular opening 50 adjacent furnace tile 46, thus forming a mixture appropriate to complete the combustion of the fuel gases in the heat-utilization equipment. Oxidant air doors 52 control oxidant flow to converging ducts 54 so as to maintain the furnace at a desired stoichiometry in the range of about 1.1 to about 1.3, preferably about 1.2.

Sulfur sorbent is introduced to the system by any suitable means such as tangential injectors 56 (FIG. 2) or, alternatively, a single tubular injector 53 (FIG. 2A) which may be, for example, a coaxial-pintle injector assembly of the type described in U.S. Pat. No. 4,386,443 to Burge et al. incorporated herein by reference.

The combustion gases contain sulfur constituents in various forms. The predominant constituent is sulfur dioxide ($SO_2$). Other constituents which may be present include sulfur trioxide ($SO_3$), carbonyl sulfide (COS), $H_2S$ and carbon disulfide ($CS_2$). When combined with the supplementary oxidant they, in the main, convert to sulfur dioxide.

The alkaline earth metals of the sulfur sorbent react with the sulfur dioxide before effective temperature becomes too high, i.e., where kinetics favor the reverse reaction. It is, therefore, desirable to achieve a combination of sulfur sorbent, supplemental oxidant and sulfur constituents in a regime where effective temperature is below about 2300° F.

In the case of calcium compounds, for example, calcination at temperatures less than 2300° F. results in forming a material having unusually high reactivity towards $SO_2$. This accomplished as follows: The combustion gases exiting duct 40 are mixed thoroughly with both sulfur sorbent and supplemental oxidant. Mixing this supplementary oxidant (e.g. air) into the gaseous products reduces the average temperature of the gaseous products to a temperature within the range from about 1600° F. to about 2300° F., preferably about 2000° F. Preferably, these events occur within particle transit times of the order of 1 to 10 seconds and within a distance of about 3 to about 12 feet from the point where the gaseous products enter the furnace 36. In this region sulfur capture will occur by simplified reactions such as $$CaCO_3 \xrightarrow{heat} CaO + CO_2 \text{ (calcination)}$$

$$2CaO + 2SO_2 + O_2 \longrightarrow 2CaSO_4 \text{ (sulfate formation)}$$

The sulfur capture reaction is reversible with kinetics being directly proportional to temperature and unfavorable at temperatures above about 2300° F.

It is also significant that the calcium compounds, such as limestone, in the process of calcining subdivide by the combination of gas evolution and thermal stress exposing a maximum amount of surface for sulfur capture. Limestone is the cheapest alkaline earth metal sulfur sorbent and therefore preferred; other suitable sorbents are dolomite, hydrated lime, pressure hydrated lime and the like.

At inflow into the heat-utilization equipment 36, the gaseous products from the slag recovery chamber 30 constitute about 75–85 percent of the total inflow to the boiler or furnace. Such gaseous products therefore constitute a copious source of heat energy for rapidly calcining the sulfur sorbent. Also, they provide swirling-flow kinetic energy to aid thorough mixing of the sulfur sorbent and supplementary oxidant into the gaseous-products stream. Accordingly, sulfur constituents contained in the gaseous products are contacted with the sulfur sorbent at temperatures in the range from about 1600° F. to about 2300° F., more preferably between about 1800° F. to about 2000° F., within times of the order of a few seconds after entering the furnace or boiler.

Figure 2A:
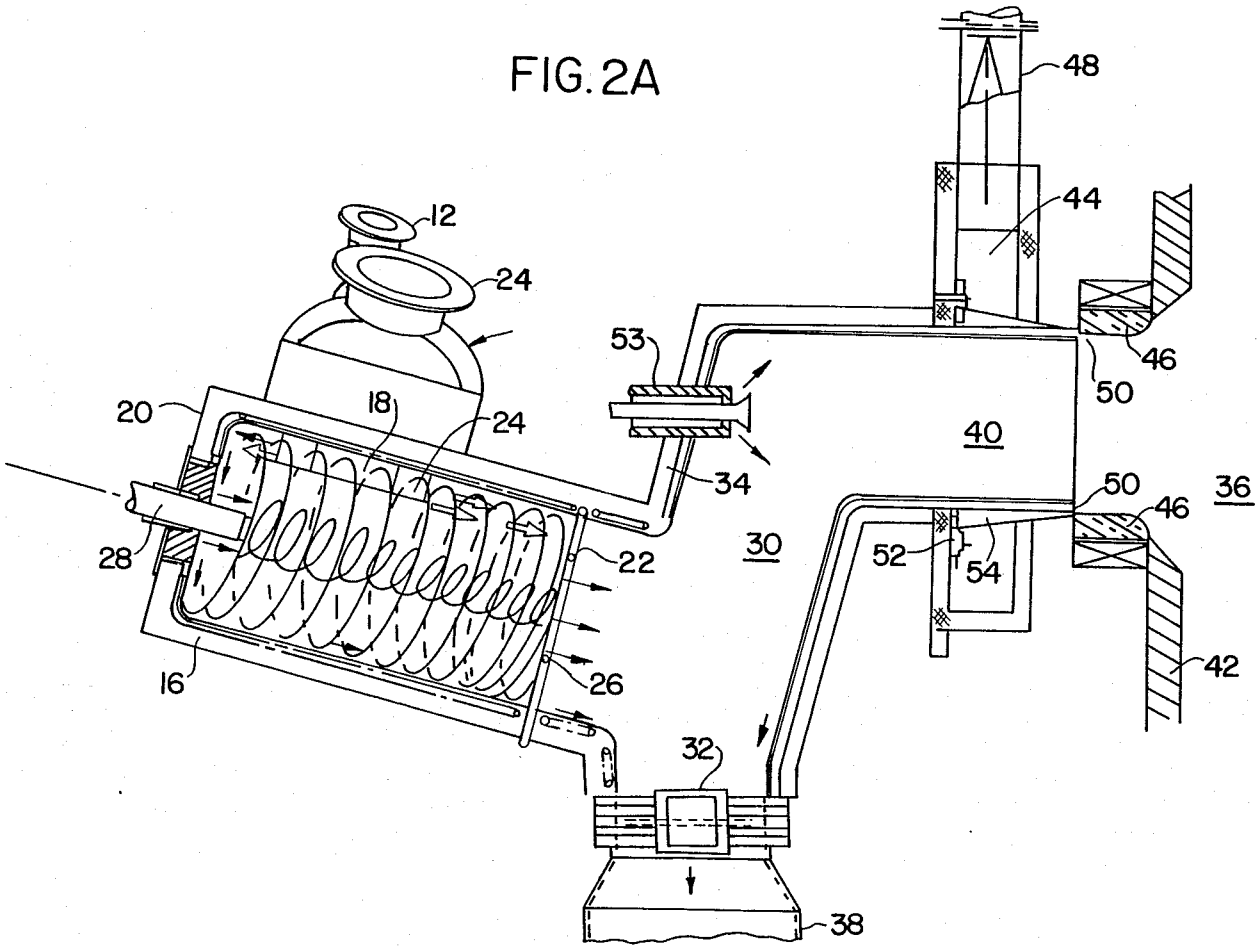
FIG. 2A shows an alternate location of an injector to add sulfur sorbent to the gas stream passing to the end-use equipment.

Alternatively, with reference to FIG. 2A, sulfur sorbent may be introduced into the gaseous products shortly after such products leave the slag-recovery chamber as by pintle valve 53, and while these gaseous products are above the ash-fusion temperature. This has the advantage of promoting rapid calcining, within times of the order of 2 to 20 milliseconds; while "dead burning" or structural changes in the lattice or matrix structure of the sulfur sorbent is avoided because the sulfur sorbent is carried into a lower-temperature environment, i.e., the furnaces or boiler, within transit times of a fraction of a second.

In this time frame, the particles do not have the opportunity to reach bulk gas temperature and the regime about the particles are maintained at an effective temperature of about 2300° F. or less. In the boiler, the gaseous products are also quickly cooled to the lower temperature regime, i.e., 1800° F. to about 2000° F., by the combination of several cooling mechanisms: radiation heat transfer to the much colder water-tube walls of the boiler; convective mixing with cooler gases circulating within the boiler or furnace; and mixing with additional secondary oxidant, introduced simultaneously with the sorbent or introduced separately and mixed with the gaseous combustion products within the boiler.

We believe that operation at temperatures, in the furnace, exceeding about 2300° F. is to be avoided, in that the reverse reaction (decomposing $CaSO_4$ to form $SO_2$) becomes significant at higher temperatures. It is our experience, however, that short-time excursions above 2300° F. can be tolerated without adversely affecting the sulfur sorbent's ability to remain porous for sulfur capture. It is presently preferred to employ as the sorbent, limestone particles of a particle size generally less than 200 mesh. It has been observed, however, that the ability to capture sulfur is not particularly dependent on particle size and pulverized sulfur sorbents within the range from about 0.5 to about 70 microns have been used with good results.

An important aspect of our invention is that the slagging combustor system removes 80–90% of the non-combustible minerals from the gaseous products before such products pass through duct 40 to furnace 36. This is significant in the sense that if the sulfur sorbent were contacted by material amounts of solids such as fly-ash, deactivation would occur, rendering the sulfur sorbent less effective for sulfur capture. In addition to cooling by mixing and dilution, additional cooling to the desired temperature occurs by radiation to the furnace walls and back flow of cooler furnace gases. Secondary oxidant introduction may be in any manner desired, including rotational flow, co-current or countercurrent to the flow of combustion gases exiting the duct 40.

Figure 4:
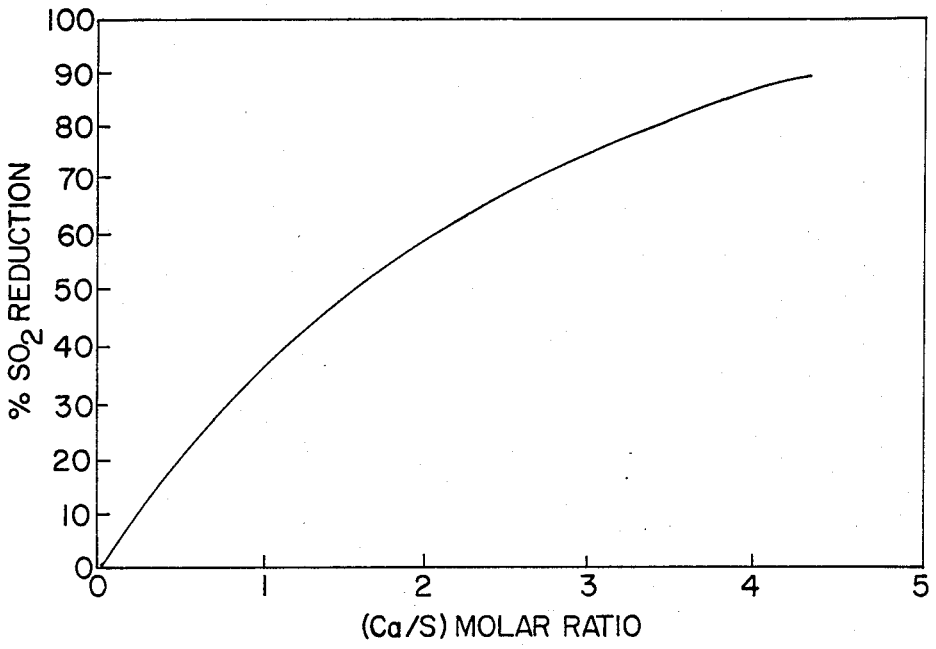
FIG. 4 is a plot of percent sulfur capture as a function of calcium-to-sulfur (Ca/S) molar ratio for a variety of runs using Vicron TM and Marblewhite TM 200 limestone.

As indicated, sulfur sorbent can be introduced with the oxidant or with the products of combustion provided residence time is short such that the particles do not "dead burn". With reference to FIG. 4 there is shown sulfur capture as a function the (Ca/S) molar ratio, the curve shown is a best fit of the results of several runs including sulfur sorbent injection as shown in FIG. 2A. The sulfur sorbent materials used were Vicron TM 200 limestone and differing coals. The sulfur sorbent materials performed equally well, as compared to each other, and at a calcium-to-sulfur molar ratio of approximately 2.5 to 3.5 yielded sulfur reductions of from 80 to 90%. When the sulfur content of the coal is small, a higher calcium-to-sulfur molar ratio is required to achieve equivalent $SO_2$ reduction. Accordingly, the range of calcium-to-sulfur molar ratios is from 2 to about 5 more, preferably about 2.5 to about 3.5.

Sulfur sorbent injection directly into the combustion products, as shown in FIG. 2A, seems to indicate a slightly higher degree of sulfur capture than sulfur capture by injection of sorbent into the secondary oxidant, all other factors being the same. As indicated, sulfur capture appears complete in the region of between 4 and 12 feet from the point of secondary oxidant introduction to boiler 36.

Figure 3:
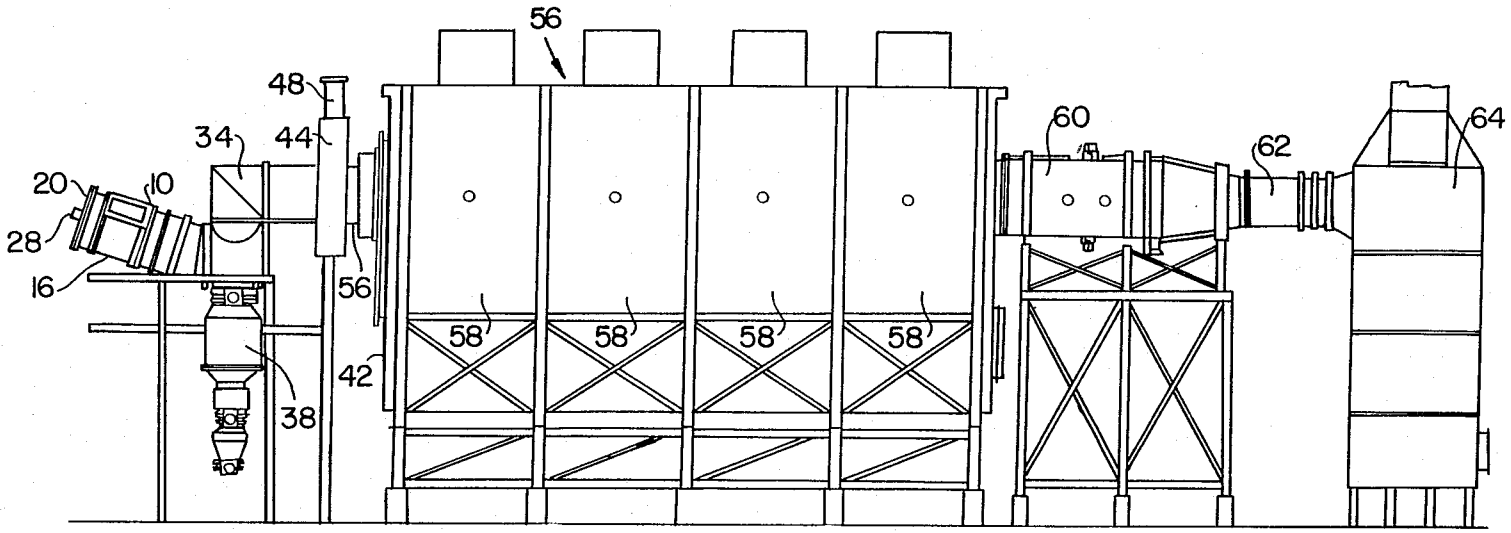
FIG. 3 is a side view of the apparatus of FIGS. 1 and 2 as operated in conjunction with a boiler simulator.

FIG. 3 depicts a slagging combustion system, having a nominal power rating of 40MM BTU per hour, coupled to a boiler simulator 56 which includes an assembly of heat extraction modules 58 having water-cooled inner and outer walls. The inner walls simulate well the radiative characteristics of a typical furnace. Coupled together at one end 42 is duct 40 from the primary combustor 16 where first stage combustion occurs to yield a swirling flow of products of combustion which are fuel rich having an oxygen-to-fuel ratio of about 0.7 to 0.9. Typically, as used in the hereinafter-described tests, the slagging combustor was controlled to:

(a) remove from the gaseous products about 70 to 80% of the noncombustible minerals, and (b) provide to simulator 56 a stream of gaseous products at a temperature of 2600° F. to about 3200° F.

Duct 34 combined together with the oxidant and sorbent injection system 44, feed the boiler which preferably operates at a stoichiometry of from about 1.1 to about 1.3, more preferably about 1.2. Careful control over stoichiometry is important to achieve the proper conditions for $SO_2$ reduction.

Generally, combustion gases enter the boiler in a high-velocity swirling flow, at a temperature of about 2600° F. to about 3200° F., and with a stoichiometry of about 0.7 to about 0.9. Sufficient oxidant is introduced to preferably increase the overall stoichiometry to about 1.2 and sulfur sorbent introduction is sufficient to provide a calcium-to-sulfur molar ratio of from about 2 to about 5, preferably from about 2.5 to about 3.5, depending upon the sulfur content of the fuel. The combination of sorbent and supplementary oxidant dilution, radiative heat transfer and back flow of cooler furnace gases reduce gas temperature to about 2000° F. or less wherein sulfur compound elimination by sulfur sorbent takeup occurs rapidly. The gases after passing through the boiler simulator 56 enter convection section 60 where additional heat is removed, then to quench chamber 62 where the gases are cooled by water injection and finally to scrubber 64 where spent and partially spent sorbent and any slag particles which eluded recovery are collected before the exhaust products are emitted to the atmosphere. Without being intended to limit our invention, the following examples of actual tests demonstrate the efficacy of sulfur capture according to the practice of the instant invention.

EXAMPLE 1

Two coals were evaluated. One, Pittsburgh No. 8, contained about 2% sulfur, and the other Wyoming Rosebud, contained about 0.6% sulfur. Sorbents tested were pulverized limestone, Vicron TM brand of calcium carbonate manufactured and sold by Pfizer Inc., and pressure hydrated dolomite lime. The first tests involved Pittsburgh No. 8 coal and pulverized limestone. Sulfur dioxide reduction was about 90%, at a calcium-to-sulfur molar ratio of 3. The test was repeated with identical results. Vicron TM absorbent was next used and gave similar sulfur dioxide reductions, at a calcium-to-sulfur molar ratio of 3.

The next test series used Wyoming coal and Vicron TM sulfur sorbent. It was found that excellent sulfur capture, in the range from about 70% to 90%, was obtained even with this Western coal, which has a relatively low sulfur content of about 0.6 percent.

The boiler simulator depicted in FIG. 3 was coupled to a 40 MMBTU/hr nominal combustor, as before. Air feed temperature was in the range of 100° F. to 500° F. to the precombustor. About 25% of the powdered coal was consumed in the precombustor to deliver oxidant (air) at temperatures of 1500° F. to 2000° F. The hot air was tangentially introduced into the slagging combustor 16.

Coal was delivered in a dense phase at a total rate, i.e., precombustor and primary combustor, of about 1.5 tons per hour. Bulk gas flow residence time in the boiler simulator was about 4.5 seconds. Incoming primary combustor combustion products were in excess of 3000° F. Incoming secondary air was at a temperature of about 450° F. and produced exhaust products were at exit, at a temperature of 1800° F. to 2000° F.

EXAMPLE 2

Operating the combustor-simulator combination as described in Example 1 and depicted in FIG. 2, sulfur capture tests were performed on Ohio No. 6 coal using two sorbents, Vicron TM and Marblewhite TM 200 limestone. Both tests were performed under steady state conditions. Typical analysis of Vicron TM, the chemical analysis of Vicron TM and Marblewhite TM 200 are shown in Table I. The Ohio No. 6 coal had an average particle size of about 50 microns. The Vicron TM and Marblewhite TM 200 have an average particle size of about 50 microns by sieve analysis. The preliminary studies indicated that Vicron TM and Marblewhite TM 200 behaved identically, both removing from 45 to 80% of the sulfur at a calcium-to-sulfur ratio of about 2 and from 55 to 90% at a calcium-to-sulfur ratio of about 3 with sulfur capture completed within 4 to 12 feet from the point where the secondary air enters the boiler simulator, and compete within 50% of the length of the boiler simulator depicted in FIG. 3.

TABLE 1

SULFUR SORBENT ANALYSES (w/w percent)

| | Vicron TM (1) Analysis 1 | Analysis 2 | Marblewhite TM 200(1) Limestone |
|---|---|---|---|
| $CaCO_3$ | 98% | 96.65% | 98% |
| $MgCO_3$ | 0.6% | 1.6% | 0.6% |
| $SiO_3$ | 0.2% | 1.0% | 0.2% |
| $Al_2O_3$ | 0.1% | 0.5% | 0.1% |
| $Fe_2O_3$ | 0.025% | 0.05% | 0.025% |
| Moisture | 0.2% | 0.2% | 0.2% |
| Other | 0.875% | 0% | 0.875% |

(1) Manufactured and sold by Pfizer, Inc. Analyses obtained per discussion with Pfizer representative on two occasions. For Vicron TM, analysis 1 was more recently obtained than analysis 2.

While the present invention has been illustrated and described with reference to certain preferred embodiments only, it will be obvious to those skilled in the art that it is not so limited but is susceptible of various changes and modifications without departing from the spirit and scope thereof.

We claim:

1. In an apparatus for combustion of sulfur-containing particulate carbonaceous fuel wherein oxidizer gas and particulate fuel are introduced into a substantially cylindrical primary combustion chamber and wherein the input velocities, mass-flow rates and combustion temperatures are regulated to minimize the concentration of volatilized and liquid slag in the output gaseous products of combustion, and wherein the walls of the combustion chamber are maintained within a temperature range such that a layer of solidified slag is retained on the inside surfaces of the walls, the improvement comprising, in combination:

(a) means for preheating said oxidizer gas and introducing the preheated oxidizer gas into said chamber in a manner to establish a high-velocity swirling flow of a mixture comprising oxidizer and combustion products within said chamber;

(b) means for injecting particulate fuel into said chamber near the center of one end thereof in a pattern such that substantially all of the fuel particles are intercepted by said swirling flow and most of the carbon contained in the particles is converted to oxides of carbon before the particles reach the walls of the chamber;

(c) means regulating the oxidizer and fuel input velocities and mass-flow rates for maintaining a relatively fuel-rich combustion regime within a longitudinally-extending central portion of the primary combustion zone within said chamber, providing a relatively oxygen-rich annular region adjacent the walls, driving substantially all the slag content of the fuel to the walls of the chamber and keeping the temperature of the gaseous combustion products substantially higher than the ash-fusion temperature of the non-combustible constituents of the fuel;

(d) slag recovery means comprising a slag-recovery chamber coupled to receive combustion products from said primary combustion chamber for collecting substantially all liquid slag entrained in said combustion products, separately disposing of all slag collected in the system, and conducting thermal energy-carrying gaseous products to an associated heat utilization equipment;

(e) sulfur-capture means for combining with said gaseous products, substantially as such products enter the heat utilization equipment, (i) sufficient calcium-containing sorbent to provide a calcium-to-sulfur molar ratio in the range from about 2 to about 5 and (ii) sufficient supplementary oxidizer to keep the temperature at which said sorbent initially contacts sulfur constituents of the gaseous products within the range from about 1600° F. to about 2300° F;

(f) with said sulfur-capture means comprising sorbent injection means for introducing calcium-containing sorbent into the gaseous products downstream from said primary combustion zone and before such products pass into the heat utilization equipment, and oxidant addition means for adding supplementary oxidant to said gaseous products after removal of substantially all non-combustible mineral constituents therefrom, and with said sorbent injection means and oxidant addition means being operative to maintain a time-temperature profile for the sorbent particles in transit to and through the heat utilization equipment such that the sulfur sorbent reacts with and captures a preponderance of the sulfur constituents at an effective capture temperature of less than about 2300° F., while maintaining a stoichiometry in the heat utilization equipment of from about 1.1 to about 1.3.

2. The apparatus of claim 1 wherein the means regulating the oxidizer and fuel input velocities and mass-flow rates is adapted to drive at least about 80 percent of the slag content of the fuel to the walls of the chamber.

3. The apparatus of claim 1 wherein the sulfur-capture means is adapted to capture at least 60 percent of the sulfur constituents.

4. An apparatus for combusting a carbonaceous fuel comprising carbon, sulfur, and noncombustibles, the apparatus comprising:

(a) a primary combustion chamber having a head end and an exit end connected by a peripheral wall;

(b) oxidant introduction means for introducing a flow of oxidant into the primary combustion chamber intermediate the ends in a manner to establish a high velocity swirling flow field within the primary combustion chamber;

(c) fuel introduction means in communication with the primary combustion chamber for introducing the fuel into the primary combustion chamber in a pattern so that substantially all of the fuel is intercepted by the swirling flow field and most of the carbon contained in the fuel is converted to oxides of carbon before the fuel reaches the wall of the primary combustion chamber;

(d) input regulation means for independently regulating the input velocities and mass flow rates of the oxidant and the fuel so that the fuel is combusted in the presence of the oxidant in the primary combustion chamber under substoichiometric combustion conditions to form liquid slag and gaseous combustion products comprising sulfur and oxides of carbon, wherein substantially all of the carbon content of the fuel is converted to oxides of carbon before the gaseous combustion products leave the primary combustion chamber, the temperature within the primary combustion chamber is maintained above the ash fusion temperature of the fuel, and a majority of the noncombustibles are driven to the peripheral wall of the primary combustion chamber to form treated gaseous combustion products that leave the primary combustion chamber and have a temperature above the ash fusion temperature of the fuel and a noncombustible content that is substantially reduced with respect to the noncombustible content of the fuel for delivery to an associated heat-utilization equipment;

(e) slag removal means in fluid communication with the primary combustion chamber for removing a majority of the liquid slag from the primary combustion chamber; and (f) sorbent introduction means in communication with the treated gaseous combustion products for introducing a sorbent having a first sulfur capture capacity into the treated gaseous combustion products downstream from the primary combustion zone substantially as the treated gaseous combustion products are delivered to the heat-utilization equipment, the sorbent introduction means being adapted so that the sorbent is rapidly mixed with the treated gaseous combustion products to calcine the sorbent, the calcined sorbent having a second sulfur capture capacity that is greater than the first sulfur capture capacity, so that the sulfur content of the treated gaseous combustion products is capable of being substantially reduced with respect to the sulfur content of the fuel.

5. The apparatus of claim 4 further comprising a transition conduit in fluid communication with the primary combustion zone, the transition conduit being adapted to receive the treated gaseous combustion products from the primary combustion chamber.

6. The apparatus of claim 5 wherein the sorbent introduction means is adapted to introduce the sorbent into the transition conduit.

7. The apparatus of claim 4 wherein the sorbent introduction means is adapted (a) to introduce the sorbent into treated gaseous combustion products having a temperature above the ash fusion temperature of the fuel and (b) so that the treated gaseous combustion products and the calcined sorbent form a mixture and the apparatus further comprises temperature reduction means in communication with the primary combustion chamber for reducing the temperature of the mixture to prevent any significant deadburn of the sorbent.

8. The apparatus of claim 7 wherein the temperature reduction means is a heat utilization device that is capable of utilizing chemical potential energy in the fuel.

9. The apparatus of claim 4 further comprising additional oxidant introduction means in fluid communication with the treated gaseous combustion products for introducing additional oxidant into the treated gaseous combustion products downstream from where the treated gaseous combustion produces leave the primary combustion chamber, the additional oxidant introduction means being adapted so that the additional oxidant is sufficient to enable the oxides of carbon in the treated gaseous combustion products to be substantially completely oxidized.

10. The apparatus of claim 9 wherein the additional oxidant introduction means is adapted to introduce the additional oxidant into the transition zone.

11. In a process for combustion of sulfur-containing particulate carbonaceous fuel wherein oxidizer gas and particulate fuel are introduced into a substantially cylindrical combustion zone and wherein the input velocities, relative mass-flow rates and temperatures are regulated to keep combustion temperatures in said zone above the ash-fusion temperature of non-combustible constituents of the fuel while minimizing the concentration of volatilized and liquid slag in the output gaseous products of combustion, the improvement comprising the steps of:

(a) preheating said oxidizer gas and introducing the preheated oxidizer gas into said zone in a manner to establish a high-velocity swirling flow of a mixture comprising oxidizer and combustion products within said zone;

(b) injecting particulate fuel into said zone near the center of one end thereof in a pattern such that substantially all of the fuel particles are intercepted by said swirling flow and most of the carbon contained in the particles is converted to oxides of carbon before the particles exit from said zone;

(c) regulating the oxidizer and fuel input temperatures, velocities and mass-flow rates to maintain a relatively fuel-rich combustion regime within a longitudinally-extending central portion of the combustion zone, provide a relatively oxygen-rich annular region adjacent the periphery of said zone, drive substantially all the slag content of the fuel to the periphery of said zone, and keep the temperature of the gaseous combustion products substantially higher than the ash-fusion temperature of the non-combustible constituents of the fuel;

(d) collecting substantially all liquid slag entrained in said combustion products, separately disposing of all slag, and conducting thermal energy-carrying gaseous products to an associated heat utilization equipment;

(e) combining with said gaseous products, substantially as such products enter the heat utilization equipment, (i) sufficient calcium-containing sorbent to provide a calcium-to-sulfur molar ratio in the range from about 2 to about 5 and (ii) sufficient supplementary oxidizer to keep the temperature at which said sorbent initially contacts sulfur constituents of the gaseous products within the range from about 1600° F. to about 2300° F.;

(f) with said calcium-containing sorbent being introduced into the gaseous products before such products pass into the heat utilization equipment, said supplementary oxidizer being mixed with the gaseous products after removal of substantially al noncombustible mineral constituents therefrom; and (g) maintaining a time-temperature profile for the sorbent in transit to and through the heat utilization equipment which enables the sulfur sorbent to react with and capture a preponderance of the sulfur constituents at an effective capture temperature of less than about 2300° F., while maintaining a stoichiometry in the heat utilization equipment of from about 1.1 to about 1.3.

12. The process of claim 11 wherein the step of regulating the oxidizer and fuel input temperatures, velocities and mass-flow rates includes the step of driving at least about 80 percent of the slag content of the fuel to the periphery of the combustion zone.

13. The process of claim 11 wherein the step of maintaining a time-temperature profile for the sorbent in transit to and through the heat utilization equipment includes the step of capturing at least 60 percent of the sulfur constituents.

14. A process for combusting a carbonaceous fuel comprising carbon, sulfur, and noncombustibles, the process comprising the steps of:

(a) introducing a flow of oxidant into a primary combustion zone having a head end and an exit end connected by a peripheral wall, the flow of oxidant being introduced intermediate the ends in a manner to establish a high velocity swirling flow field within the primary combustion zone;

(b) introducing the fuel into the primary combustion zone in a pattern so that substantially all of the fuel is intercepted by the swirling flow field and most of the carbon contained in the fuel is converted to oxides of carbon before the fuel reaches the wall of the primary combustion zone;

(c) independently regulating the velocities and mass flow rates of the oxidant and the fuel so that the fuel is combusted in the presence of the oxidant in the primary combustion zone under substoichiometric combustion conditions to form liquid slag and gaseous combustion products comprising sulfur and oxides of carbon, wherein substantially all of the carbon content of the fuel is converted to oxides of carbon before the gaseous combustion products leave the primary combustion zone, the temperature within the primary combustion zone is maintained above the ash fusion temperature of the fuel, and a majority of the noncombustibles are driven to the peripheral wall of the primary combustion zone to form treated gaseous combustion products that leave the primary combustion zone and have a temperature above the ash fusion temperature of the fuel and a noncombustible content that is substantially reduced with respect to the noncombustible content of the fuel for delivery to an associated heat-utilization equipment;

(d) removing a majority of the liquid slag from the primary combustion zone; and (e) introducing a sorbent having a first sulfur capture capacity into the treated gaseous combustion products downstream from the primary combustion zone substantially as the treated gaseous combustion products are delivered to the heat-utilization equipment and rapidly mixing the sorbent with the treated gaseous combustion products to calcine the sorbent, the calcined sorbent having a second sulfur capacity that is greater than the first sulfur capture capacity, so that the sulfur content of the treated gaseous combustion products is capable of being substantially reduced with respect to the sulfur content of the fuel.

15. The process of claim 14 wherein the regulating step includes the step of independently regulating the input velocities and mass flow ratios of the oxidant and the fuel so that the treated gaseous combustion products have a temperature of about 2600° to about 3200° F.

16. The process of claim 14 further comprising the step of introducing additional oxidant into the treated gaseous combustion products and rapidly mixing the additional oxidant with the treated gaseous combustion products, the additional oxidant being sufficient to raise the stoichiometry of the process from substoichiometric to at least about 1.

17. The process of claim 16 wherein the step of introducing additional oxidant comprises introducing the additional oxidant into the treated gaseous combustion products downstream from where the treated combustion products leave the primary combustion zone substantially as the treated gaseous combustion products are delivered to the heat-utilization equipment.

18. The process of claim 14 wherein the step of introducing the sorbent includes the step of introducing the sorbent into treated gaseous combustion products having a temperature above the ash fusion temperature of the fuel, and forming a mixture comprising the treated gaseous combustion products and the calcined sorbent, and the process further comprises the step of reducing the temperature of the mixture to prevent any significant deadburn of the sorbent.

19. The process of claim 18 wherein the temperature reduction step includes the step of reducing the temperature of the mixture to below about 2300° F.

20. The process of claim 18 wherein the temperature reduction step includes the step of reducing the temperature of the mixture to below about 2300° F. within 2 to 20 milliseconds after the sorbent is introduced into the treated gaseous combustion products.

21. The process of claim 18 wherein the temperature reduction step includes the step of introducing the mixture into the heat utilization zone for (i) substantially completing the oxidation of the oxides of carbon in the treated gaseous combustion products with the additional oxidant; (ii) use of chemical potential energy in the fuel in the heat utilization zone; and (iii) reducing the sulfur content of the treated gaseous combustion products with the calcined sorbent.

22. A process for combusting a carbonaceous fuel comprising carbon, sulfur, and noncombustibles, the process comprising the steps of:

(a) introducing oxidant into a primary combustion zone having a head end and an exit end connected by a peripheral wall, the oxidant being introduced intermediate the ends in a manner to establish a high velocity swirling flow field within the primary combustion zone;

(b) introducing the fuel into the primary combustion zone near the center of one end in a pattern so that substantially all of the fuel is intercepted by the swirling flow field and most of the carbon contained in the fuel is converted to oxides of carbon before the fuel reaches the wall of the primary combustion zone;

(c) independently regulating the velocities and mass flow rates of the oxidant and the fuel so that the fuel is combusted in the presence of the oxidant in the primary combustion zone under stoichiometric combustion conditions to form liquid slag and gaseous combustion products comprising sulfur and oxides of carbon, wherein substantially all of the carbon content of the fuel is converted to oxides of carbon before the gaseous combustion products leave the primary combustion zone, the temperature within the primary combustion zone is maintained above the ash fusion temperature of the fuel, and a majority of the noncombustibles are driven to the peripheral wall of the primary combustion zone to form treated gaseous combustion products that leave the primary combustion zone and have a temperature above the ash fusion temperature of the fuel and a noncombustible content that is substantially reduced with respect to the noncombustible content of the fuel for delivery to an associated heat-utilization zone;

(d) removing a majority of the liquid slag from the primary combustion zone;

(e) passing the treated combustion products leaving the primary combustion zone through a transition zone;

(f) introducing a sulfur sorbent into the treated gaseous combustion products downstream from where the treated gaseous combustion products leaves the primary combustion zone substantially as the treated gaseous combustion products are delivered to the heat-utilization zone, the treated gaseous combustion products having a temperature above the ash fusion temperature of the fuel, and rapidly mixing the sorbent with the treated gaseous combustion products to calcine the sorbent and to form a mixture comprising the treated gaseous combustion products and calcined sorbent, then calcined sorbent having a greater sulfur capture capacity than the introduced sorbent; and (g) after step (f), reducing the temperature of the mixture to prevent any significant deadburn of the calcined sorbent so that the calcined sorbent is capable of removing sulfur from the treated gaseous combustion products to substantially reduce the sulfur content of the treated gaseous combustion products with respect to the sulfur content of the fuel.

23. The process of claim 22 wherein the sorbent is introduced into the transition zone.

24. The process of claim 22 wherein the liquid slag removal step includes the step of removing at least about 80 percent of the noncombustible content of the carbonaceous fuel from the treated gaseous combustion products.

25. The process of claim 22 wherein the regulating step includes of the step of independently regulating the input velocities and mass flow rates of the oxidant and fuel so that most of the noncombustibles are driven to the peripheral wall of the primary combustion zone in the form of droplets of liquid slag.

26. The process of claim 22 further comprising the step of introducing additional oxidant into the treated gaseous combustion products downstream from where the treated combustion products leave the primary combustion zone substantially as the treated gaseous combustion products are delivered to the heat-utilization equipment and rapidly mixing the additional oxidant with the treated gaseous combustion products, the additional oxidant being sufficient to raise the stoichiometry of the process from substoichiometric to at least about 1.

27. The process of claim 26 wherein the additional oxidant is introduced into the transition zone.

28. The process of claim 23 wherein the temperature reduction step includes the step of introducing the mixture into the heat utilization zone for (i) substantially completing the oxidation of the oxides of carbon in the treated gaseous combustion products with the additional oxidant; (ii) use of chemical potential energy in the fuel in the heat utilization zone; and (iii) reducing the sulfur content of the treated gaseous combustion products with the calcined sorbent.

29. The process of claim 28 wherein at least 80 percent of the sulfur content of the carbonaceous fuel is removed before the treated gaseous combustion products exit the heat utilization zone.

30. The process of claim 28 wherein the temperature reduction step includes the step of introducing treated gaseous combustion products having at least about 85 percent of the chemical potential energy of the carbonaceous fuel into the heat utilization zone.

31. A process for combusting a carbonaceous fuel comprising carbon, sulfur, and noncombustibles, the process comprising the steps of:

(a) introducing a flow of oxidant into a primary combustion zone having a head end and an exit end connected by a peripheral wall, the flow of oxidant being introduced intermediate the ends in a manner to establish a high velocity swirling flow field within the primary combustion zone;

(b) introducing the fuel into the primary combustion zone in a pattern so that substantially all of the fuel is intercepted by the swirling flow field and most of the carbon contained in the fuel is converted to oxides of carbon before the fuel reaches the wall of the primary combustion zone;

(c) independently regulating the velocities and mass flow rates of the oxidant and the fuel so that (i) the fuel is combusted in the presence of the oxidant in the primary combustion zone under substoichiometric combustion conditions to form liquid slag and gaseous combustion products comprising sulfur and oxides of carbon, (ii) substantially all of the carbon content of the fuel is converted to oxides of carbon before the gaseous combustion products leave the primary combustion zone, (iii) the temperature within the primary combustion zone is maintained above the ash fusion temperature of the fuel, and (iv) a majority of the noncombustibles are driven to the peripheral wall of the primary combustion zone to form treated gaseous combustion products that leave the primary combustion zone and have a temperature above the ash fusion temperature of the fuel and a noncombustible content that is substantially reduced with respect to the noncombustible content of the fuel;

(d) removing a majority of the liquid slag from the primary combustion zone;

(e) introducing a sorbent having a first sulfur capture capacity into the treated gaseous combustion products downstream from the primary combustion zone substantially as the treated gaseous combustions products are introduced into an associated heat-utilization zone and rapidly mixing the sorbent with the treated gaseous combustion products to calcine the sorbent, thereby forming a mixture of the sorbent and the treated gaseous combustion products, the calcined sorbent having a second sulfur capture capacity that is greater than the first sulfur capture capacity so that the sulfur content of the treated gaseous combustion products is capable of being substantially reduced with respect to the sulfur content of the fuel;

(f) introducing the mixture into the heat utilization zone for recovering heat energy from the mixture and for reducing the temperature of the mixture to below about 2300° F. to prevent any significant dead burn of the sorbent; and (g) subsequent to step (f), removing sorbent from the mixture.

32. The process of claim 31 wherein the step of introducing the sorbent comprises introducing the sorbent into the treated gaseous combustion products at a temperature above the ash fusion temperature of the fuel.

33. The process of claim 31 wherein the temperature of the mixture is reduced in the heat utilization zone to below about 2300° F. within 2–20 milliseconds after the sorbent is introduced into the treated gaseous combustion products.

34. The process of claim 31 further comprising the step of introducing additional oxidant into the treated gaseous combustion products and rapidly mixing the additional oxidant with the treated gaseous combustion products substantially as the treated gaseous combustion products are introduced into the heat-utilization zone, the additional oxidant being sufficient to raise the stoichiometry of the process from substiochiometric to at least about one.

35. The process of claim 31, wherein at least 80% of the sulfur content of the carbonaceous fuel is absorbed by the absorbent before the treated gaseous combustion products are introduced into the heat utilization zone.

36. In an apparatus for combustion of a carbonaceous fuel comprising carbon, sulfur, and non-combustibles in a combustion chamber wherein the fuel input rate relative to the oxidizer input rate is regulated to maintain combustion conditions such that most of the carbon is converted to oxides of carbon contained in gaseous combustion products, and most of the non-combustibles are deposited as liquid slag, the gaseous combustion products containing sulfur constituents, such apparatus being further characterized by:

(a) means for separating most of the non-combustibles from the gaseous combustion products thereby providing treated gaseous combustion products relatively free of ash for delivery to an associated heat-utilization equipment;

(b) means for delivering said treated gaseous combustion products to said heat utilization equipment; and (c) sorbent introduction means in communication with said treated gaseous combustion products for introducing a sorbent having a first sulfur capture capacity into said treated gaseous combustion products so that the sulfur content of said gaseous combustion products is capable of being substantially reduced with respect to the sulfur content of the fuel, the sorbent introduction means being downstream from the combustion chamber and being located for introduction of sorbent into the treated gaseous products substantially as said treated gaseous combustion products are delivered to the heat-utilization equipment, the sorbent introduction means being adapted so that the sorbent is rapidly mixed with said gaseous combustion products to calcine the sorbent, the calcined sorbent having a second sulfur capture capacity that is greater than the first sulfur capture capacity.

37. The apparatus of claim 36 wherein the sorbent captures at least 60 percent of the sulfur constituents.

38. The apparatus of claim 36 further comprising a transition conduit in fluid communication with the combustion chamber, the transition conduit being adapted to receive the treated gaseous combustion products, wherein the sorbent introduction means is adapted to introduce the sorbent into the transition conduit.

39. The apparatus of claim 36 wherein the sorbent introduction means is adapted to introduce the sorbent into the treated gaseous combustion products while the treated gaseous combustion products have a temperature above the ash fusion temperature of the fuel, wherein the treated gaseous combustion products and the calcined sorbent form a mixture, and wherein said heat utilization equipment reduces the temperature of the mixture to prevent any significant deadburn of the sorbent.

40. The apparatus of claim 36 further comprising oxidant introduction means in fluid communication with the treated gaseous combustion products for introducing oxidant into the treated gaseous combustion products downstream from the combustion chamber substantially as the treated gaseous combustion products are delivered to the heat-utilization equipment, the oxidant introduction means being adapted so that the oxidant is sufficient to enable the oxides of carbon in the gaseous combustion products to be substantially completely oxidized.

41. The apparatus of claim 40 wherein the oxidant introduction means is adapted to introduce the oxidant into a transition conduit that is in fluid communication with the combustion chamber.

42. In a process for combusting a carbonaceous fuel comprising carbon, sulfur, and non-combustibles in a combustion zone wherein the fuel input mass-flow rate relative to an oxidizer input mass-flow rate is regulated to maintain combustion conditions such that most of the carbon is converted to oxides of carbon contained in gaseous combustion products and most of the non-combustibles are deposited as liquid slag, the improvement characterized by:

(a) separating liquid slag from the gaseous combustion products, thereby providing gaseous combustion products relatively free of ash for delivery to an associated heat-utilization zone, the gaseous combustion products containing sulfur constituents;

(b) delivering the gaseous combustion products to the heat-utilization zone; and (c) introducing a sorbent having a first sulfur capture capacity into the gaseous combustion products downstream from the combustion zone substantially as the gaseous combustion products are delivered to the heat-utilization zone and rapidly mixing the sorbent with the gaseous combustion products to calcine the sorbent, the calcined sorbent having a second sulfur capture capacity that is greater than the first sulfur capture capacity so that the sulfur content of the gaseous combustion products is capable of being substantially reduced with respect to the sulfur content of the fuel.

43. The process of claim 42 wherein the gaseous combustion products have a temperature of about 2600° F. to about 3200° F.

44. The process of claim 42 wherein the step of introducing the sorbent includes the step of introducing the sorbent into the gaseous combustion products having a temperature above the ash fusion temperature of the fuel, and forming a mixture comprising the gaseous combustion products and the calcined sorbent, and the process further comprises the step of reducing the temperature of the mixture to prevent any significant deadburn of the sorbent.

45. The process of claim 44 wherein the step of reducing the temperature of the mixture comprises reducing the temperature of the mixture to below about 2300° F.

46. The process of claim 45 wherein the step of reducing the temperature of the mixture comprises reducing the temperature of the mixture to below about 2300° F. within 2 to 20 milliseconds.

47. The process of claim 44 wherein the step of reducing the temperature of the mixture comprises introducing the mixture into the heat utilization zone for (i) substantially completing the oxidation of the oxides of carbon in the gaseous combustion products with additional oxidant; (ii) use of chemical potential energy in the fuel in the heat utilization zone; and (iii) reducing the sulfur content of the gaseous combustion products with the calcined sorbent.

48. The process of claim 42 further comprising the step of introducing oxidant into the gaseous combustion products and rapidly mixing the additional oxidant with the gaseous combustion products, the introduced oxidant being sufficient to raise the stoichiometry of the process from substoichiometric to at least about 1.

49. The process of claim 48 wherein the step of introducing additional oxidant comprises introducing the oxidant into the gaseous combustion products downstream from the combustion zone substantially as the gaseous combustion products are delivered to the heat-utilization zone.

50. The process of claim 47 wherein at least 80 percent of the sulfur content of the carbonaceous fuel is removed before the gaseous combustion products exit the heat utilization zone.

51. The process of claim 47 wherein the step of reducing the temperature of the mixture comprises introducing gaseous combustion products having at least about 85 percent of the chemical potential energy of the carbonaceous fuel into the heat utilization zone.

52. The process of claim 42 wherein the step of separating liquid slag comprises removing at least about 80 percent of the noncombustible content of the carbonaceous fuel from the gaseous combustion products.

53. The process of claim 42 wherein the step of introducing the sorbent comprises introducing the sorbent into the gaseous combustion products at a temperature above the ash fusion temperature of the fuel.

54. The process of claim 43 wherein at least 80 percent of the sulfur content of the carbonaceous fuel is absorbed by the sorbent before the gaseous combustion products are introduced into the heat utilization zone.

55. The process of claim 42 wherein the step of separating the liquid slag comprises driving at least about 80 percent of the slag content of the fuel to the periphery of the combustion zone.

56. The invention of claim 4, 14, 22, 31, 36, or 42 wherein the sorbent is calcium carbonate.

* * * * *